US008660464B2

(12) United States Patent
Ishino et al.

(10) Patent No.: US 8,660,464 B2
(45) Date of Patent: Feb. 25, 2014

(54) IMAGE-FORMING APPARATUS

(75) Inventors: Masahito Ishino, Osaka (JP); Masaki Kadota, Osaka (JP); Akane Tokushige, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 409 days.

(21) Appl. No.: 13/083,004

(22) Filed: Apr. 8, 2011

(65) Prior Publication Data

US 2011/0249987 A1 Oct. 13, 2011

(30) Foreign Application Priority Data

Apr. 13, 2010 (JP) ..... 2010-092529

(51) Int. Cl.
*G03G 21/00* (2006.01)
*G03G 21/06* (2006.01)
*G03G 21/08* (2006.01)

(52) U.S. Cl.
USPC ..... 399/128

(58) Field of Classification Search
USPC ..... 399/128
See application file for complete search history.

(56) References Cited

U.S. PATENT DOCUMENTS

| | | | | |
|---|---|---|---|---|
| 7,894,749 | B2 | 2/2011 | Jung et al. | |
| 2008/0118289 | A1 * | 5/2008 | Sato et al. | 399/357 |
| 2008/0159783 | A1 | 7/2008 | Jung | |
| 2013/0195507 | A1 * | 8/2013 | Morishita | 399/128 |

FOREIGN PATENT DOCUMENTS

| | | |
|---|---|---|
| CN | 101216690 | 7/2008 |
| JP | H04-314079 | 5/1992 |
| JP | 2011-162231 | 6/1999 |
| JP | 2001-255678 | 9/2001 |
| JP | 2003-005535 | 1/2003 |
| JP | 2007-199370 | 8/2007 |
| JP | 2004-314079 | 10/2012 |

OTHER PUBLICATIONS

Office Action Mailed Jul. 23, 2013in Chinese Patent Application No. 201110092397.8.

* cited by examiner

*Primary Examiner* — Ryan Walsh
(74) *Attorney, Agent, or Firm* — Dilworth & Barrese, LLP.

(57) ABSTRACT

An image-forming apparatus is equipped with a neutralization light source that is disposed between a primary transfer position and the cleaning unit, in a direction of rotation of the first image carrier that composes the image-forming unit; irradiates a first neutralization light from a position opposing the primary transfer position on a first image carrier up to a position opposing the cleaning unit; and irradiates a second neutralization light from a position opposing the developer unit for a second image carrier that composes an image-forming unit disposed adjacent to the image-forming unit at a downstream side in the direction of transfer belt rotation, up to a position opposite the primary transfer position.

11 Claims, 6 Drawing Sheets

IMAGE-FORMING APPARATUS

This application is based on and claims the benefit of priority from Japanese Patent Application No. 2010-092529, filed on 13 Apr. 2010, the content of which is incorporated herein by reference.

BACKGROUND OF THE INVENTION

1. Field of the Invention

The present invention relates to an image-forming apparatus equipped with a neutralization light source for discharging electricity on an image carrier.

2. Related Art

A method that implements a second transfer of a toner image to a sheet is widely adopted for electrographic-type image-forming apparatuses. This method is known to form an electrostatic latent image by charging a photosensitive drum surface, which is an image carrier, and exposing the charged surface. Next, a so-called toner image is formed by attaching toner to the electrostatic latent image. In a primary transfer, that formed toner-image is transferred to an intermediate transfer belt. The secondary transfer involves transferring the toner-image on the intermediate transfer belt to a sheet of paper.

Tandem-type image-forming apparatuses, for example, have an intermediate transfer belt suspended between a drive roller and a driven roller. In order to form a toner-image on a surface of the suspended intermediate transfer belt, photosensitive drums of each color (magenta (M), cyan (C), yellow (Y), and black (Bk)) are disposed opposite primary transfer rollers sandwiching the intermediate transfer belt. With the image-forming method of this image-forming apparatus, first an exposure device forms an electrostatic latent image on a cylindrical surface of each photosensitive drum, then a developer develops that electrostatic latent image. Multiple layers of produced toner images are transferred (multi-layer transfer) to the intermediate transfer belt and that multi-layer toner-image formed on the intermediate transfer belt is finally transferred to a conveyed sheet of paper.

With this kind of image-forming apparatus, generation of transfer memory images, or exposure memory images sometimes is a problem.

For that reason, an image-forming apparatus was proposed that suppressed generation of transfer memory images, or exposure memory images by being equipped with neutralizing means for neutralizing electricity, further upstream than a cleaning device disposed further downstream than transfer positions.

However, with this kind of image-forming apparatus, toner images remained on the image carrier surface when transfer performance was inadequate; electrical discharge was sometimes inadequate where there was residual toner. In this kind of image-forming apparatus, exposure memory is sometimes generated.

Conversely, with this kind of image-forming apparatus, transfer performance is increased by setting a high transfer current. However, in such a case, different transfer currents flowing into the image carrier can affect image carrier charging characteristics. A problem of transfer memory occurs in this kind of image-forming apparatus.

In contrast, an image-forming apparatus has been proposed that irradiates a neutralization light onto an image carrier surface before a sheet passes through a transfer position of that image carrier; and via an optical system, a portion of that neutralization light irradiates to a separation position where printing paper that passes through the transfer position is separated from the photosensitive body, thereby facilitating the separation of the paper.

However, because one object of this kind of image-forming apparatus is to neutralize a charge to facilitate easy separation of the paper, the layout of the optical system is limited; it is difficult to save space. Still further, intensity of light irradiated onto the surface of the image carrier fluctuates depending on the type of paper and whether toner is present, because neutralization light is irradiated from a backside of the paper; sometimes uniform neutralization (discharging electricity) is not attained because of unstable neutralization.

It was proposed for another image-forming apparatus to dispose between a transfer position of an image carrier and a cleaning unit, a first neutralization light source for neutralizing residual electrical potential after a transfer, and to dispose between the cleaning unit and an electrical charging unit, a second neutralization light source using a lower light intensity than the first neutralization light source to neutralize electricity. This image-forming apparatus uses a second neutralization light source at a downstream side of the cleaning unit to neutralize residual electrical potential that is not adequately removed by the first neutralization light source to avoid the adverse effects residual electrical potential has on a subsequent image.

However, in a tandem-type image-forming apparatus, a photosensitive drum, which is an image carrier, is positioned adjacent to the developer and transfer belt. For that reason, disposing a pre-transfer neutralization light source is difficult; costs also rise because of an increase in the number of drive circuits associated with the second neutralization light source.

SUMMARY OF THE INVENTION

The present invention aims at providing an image-forming apparatus including a neutralization light source for neutralizing an electrical charge on one image carrier, and an electrical charge of another, adjacent image carrier.

The present invention relates to an image-forming apparatus comprising: a circulating transfer belt that rotates in a predetermined direction;

a plurality of image-forming units disposed at predetermined distances in a direction of transfer belt rotation, each including an image carrier disposed opposite to a primary transfer position at an outer surface side of the transfer belt, configured to rotate around a rotating axis;

a charging unit for uniformly charging the image carrier;

an exposure unit that forms an electrostatic latent image on the image carrier;

a developer unit that uses toner to form a toner image by developing the electrostatic latent image formed by the exposure unit;

a neutralization light source that neutralizes an electric charge on the image carrier by radiating light onto the image carrier; and a cleaning unit that cleans away residual toner on the image carrier;

wherein in at least one of the image-forming units of the plurality of image-forming units, the neutralization light source is disposed between a primary transfer position and the cleaning unit, in a direction of rotation of the first image carrier that composes the image-forming unit;

irradiates a first neutralization light from a position opposing the primary transfer position on a first image carrier up to a position opposing the cleaning unit; and irradiates a second neutralization light from a position opposing the developer unit for a second image carrier that composes an image-forming unit disposed adjacent to the image-forming unit at a downstream side in the direction of transfer belt rotation, up to a position opposite the primary transfer position.

DETAILED DESCRIPTION OF THE INVENTION

The image-forming apparatus according to the present invention will now be explained with reference to the drawings provided.

Figure 1:
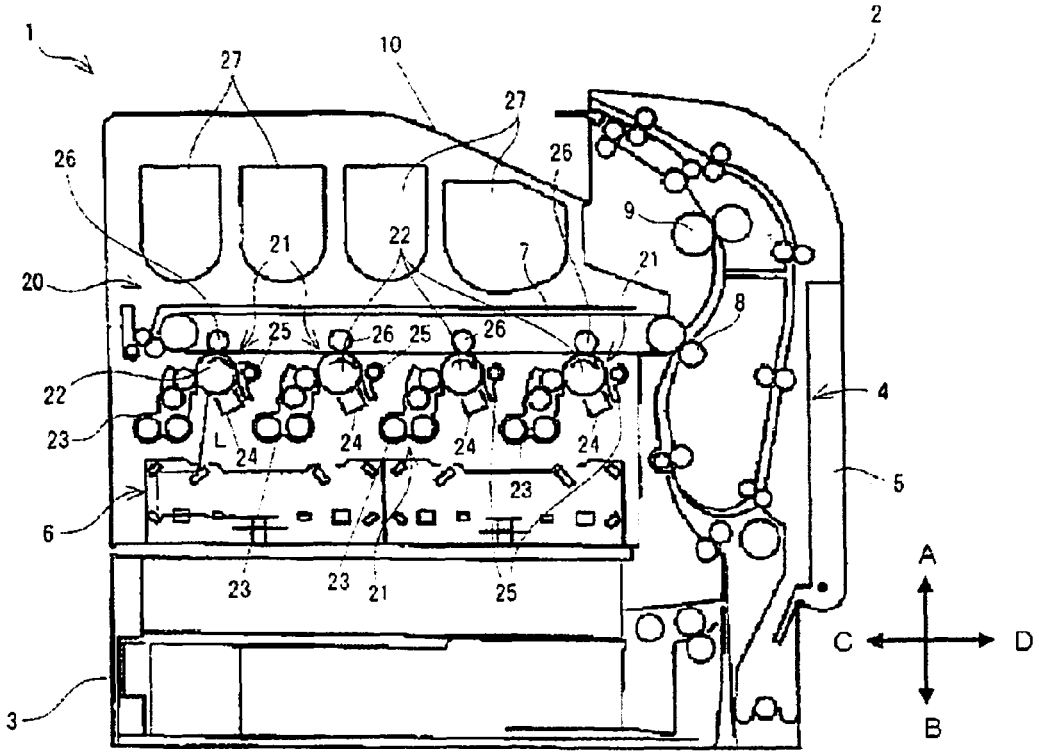
FIG. 1 is a longitudinal sectional view of an image-forming apparatus according to an embodiment of the present invention.

FIG. 1 is a longitudinal sectional view of a tandem-type image-forming apparatus according to an embodiment of the present invention. Here, to facilitate explanations of the drawings, the arrows on the right side have the following meaning: A is upward; B is downward; C is the left side; and D is the right side.

As shown in FIG. 1, a paper cassette (3) is disposed at a bottom side inside the apparatus main unit (2) of the image-forming apparatus (1). The paper cassette (3) is equipped on the right side with a paper conveyor unit (4). The paper conveyor unit (4) receives paper fed from the paper cassette (3) and conveys it vertically upward along a right-side surface of the main unit (2).

At an upper portion of the paper cassette (3), a manual paper feed unit (5) is equipped at a position corresponding to the paper conveyor unit (4) on a right side surface of the main unit (2). Sheets that are too large to fit inside the paper cassette (3) or that are difficult to feed from the paper cassette (3), such as thick sheets or OHP sheets and the like, are set in the manual paper feed unit (5). These sheets are fed into the paper conveyor unit (4) in the same way as sheets that are fed from the paper cassette (3).

The image-forming apparatus (1) receives original image data from an external computer, not shown. This image data is sent to a laser radiating unit (6) which is exposure means disposed above the paper cassette (3). The laser radiating unit (6) irradiates laser light (L) controlled based on the image data toward a photosensitive drum (22) of each image-forming units (21) in the image-forming portion (20).

As shown in FIG. 1, the image-forming portion (20) includes four image-forming units (21) above the laser radiating unit (6), and a circulating intermediate transfer belt (7) that uses as an endless belt for an intermediate transfer body, disposed above each of the image-forming units (21). The intermediate transfer belt (7) is wound onto and supported by a plurality of rollers; a drive source (not shown) rotates the intermediate transfer belt (7) in a counterclockwise direction (the rotating direction).

As shown in FIG. 1, four image-forming units (21) that compose a so-called tandem system are disposed in a line from an upstream side (left side) to a downstream side (right side), in view of the belt rotation direction, along the rotation direction of the intermediate transfer belt (7). In order, from the upstream side, these four image-forming units (21) include a yellow image-forming unit (21Y), a cyan image-forming unit (21C), a magenta image-forming unit (21M), and a black image-forming unit (21K).

The four image-forming units (21) are disposed at predetermined intervals in the rotation direction of the intermediate transfer belt (7).

Each image-forming unit (21) includes a photosensitive drum (22) which is an image carrier, a charging unit (24) that uniformly charges a surface of the photosensitive drum (22), a laser radiating unit (6) which is an exposure unit for forming electrostatic latent images on the photosensitive drum (22), a developer unit (23) of each color for forming with toner a toner image by developing the electrostatic latent image formed by the laser radiating unit (6), a neutralization light source (40) for neutralizing a charge on the photosensitive drum (22) by radiating light on the photosensitive drum (22), and a cleaning unit (25) that cleans away residual toner from the surface of the photosensitive drum (22).

Photosensitive drums (22) are disposed opposite primary transfer positions at an external side of the intermediate transfer belt (7); each is disposed to rotate around a rotating axis (shaft) perpendicular to a sheet, at predetermined distances in the rotating direction of the intermediate transfer belt (7).

Unless it is particularly necessary to limit this, the symbols M, C, Y, and K will be omitted from the explanation below.

An electrostatic latent image of an original image is formed on the photosensitive drum (22) of each image-forming units (21) by laser light (L) irradiated from the laser radiating unit (6) which is exposure means; a toner image is developed from this electrostatic latent image. The toner image is primarily transferred to a surface of the intermediate transfer belt (7) disposed above each image-forming units (21). A color toner image is formed on a surface of the intermediate transfer belt (7) by superimposing toner images of the four colors of yellow, cyan, magenta and black by transferring the toner image from each of the image-forming units (21) at predetermined timings while the intermediate transfer belt (7) rotates, as described above, in the rotating direction.

A secondary transfer roller (8) is positioned where the intermediate transfer belt (7) meets the paper conveyance path. The color toner image temporarily carried on the surface of the intermediate transfer belt (7) is transferred to the sheet synchronously fed by the paper conveyor unit (4), at a secondary nipping portion (secondary transfer position) formed by the intermediate transfer belt (7) and secondary transfer roller (8) pressing together.

A fuser (9) is disposed above the secondary transfer roller (8). The sheet transferred with the un-fused toner image by the secondary transfer roller (8) is conveyed to the fuser (9) where the toner image is heated and pressed by a heat roller and pressure roller. Thereafter, the sheet fused with the toner image is conveyed toward and discharged into a discharge tray (10).

The image-forming unit of the image-forming apparatus according to the present invention will now be explained in more detail with reference to the drawings.

Figure 2:
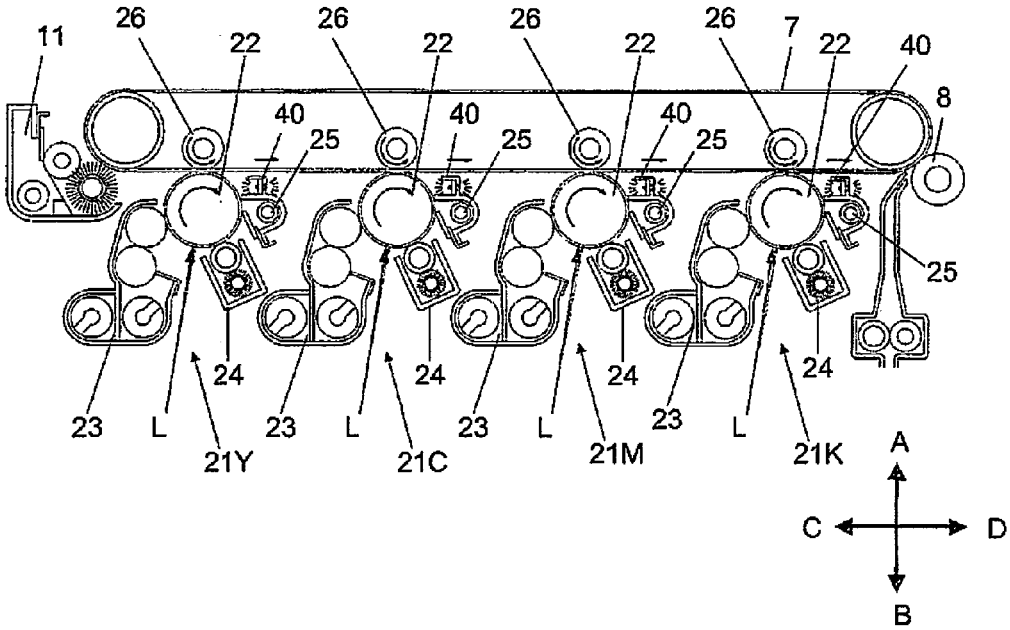
FIG. 2 is a longitudinal sectional view to explain an image-forming portion of the image-forming apparatus according to an embodiment of the present invention.
Figure 3:
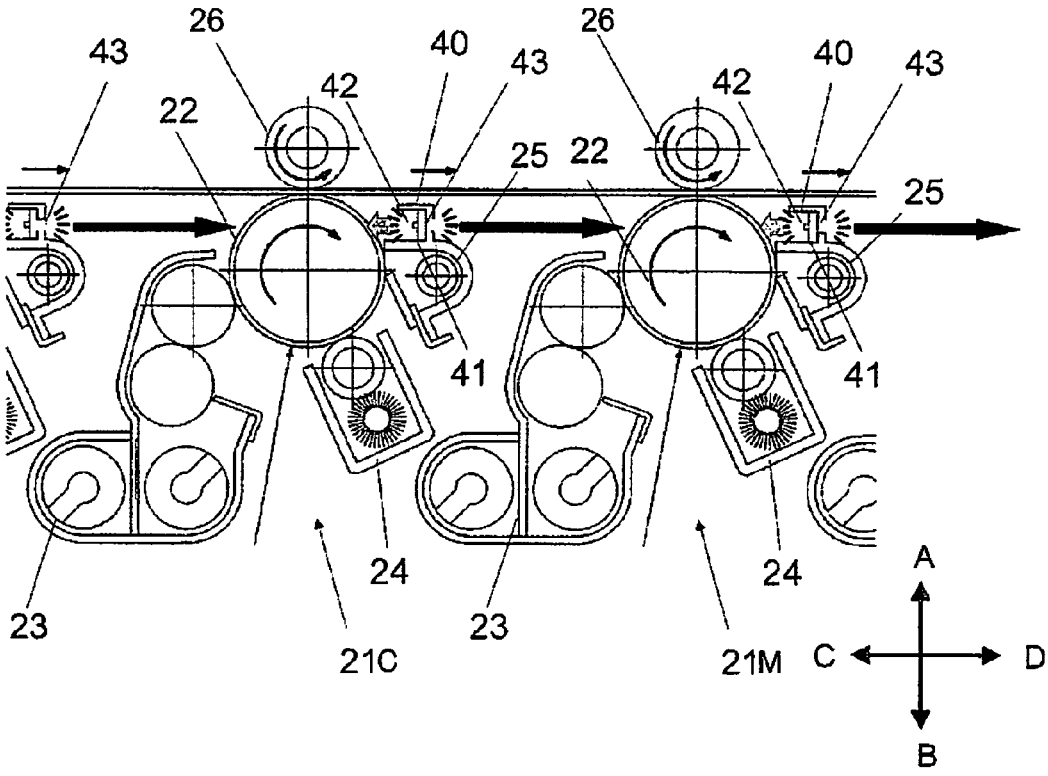
FIG. 3 is an expanded longitudinal sectional view to explain an image-forming portion of the image-forming apparatus according to an embodiment of the present invention.

FIG. 2 is a longitudinal sectional view to explain the image-forming unit of the image-forming apparatus according to an embodiment of the present invention. FIG. 3 is an expanded longitudinal sectional view to explain the image-forming unit of the image-forming apparatus according to an embodiment of the present invention. Here, to facilitate explanations of the drawings, the arrows on the right side have the following meaning: A is upward; B is downward; C is the left side; and D is the right side.

The image-forming units (21) are disposed at a lower side of the intermediate transfer belt (7). From the left side, which is an upstream side in the direction of rotation of the intermediate transfer belt (7), to the right side, image-forming units (21) include with a yellow image-forming unit (21Y), a cyan image-forming unit (21C), a magenta image-forming unit (21M), and a black image-forming unit (21K), a toner image of each color is superimposed on the intermediate transfer belt (7) to form a full-color toner image.

A toner image of each color formed on the surface of the photosensitive drum (22) is transferred in turn from the surface of the photosensitive drum (22) to the intermediate transfer belt (7) at each primary transfer nipping portion (primary transfer position) formed between the corresponding primary transfer roller (26) and the intermediate transfer belt (7). This forms a full-color toner image on the surface of the intermediate transfer belt (7).

Each image-forming unit (21) includes a neutralization light source (40) for neutralizing an electrical charge that exists on the cylindrical surface of the photosensitive drum (22) and converting electrical potential to substantially 0, after the toner image is transferred to the intermediate transfer belt (7). A neutralization light source (40) is positioned at a right side of the rotating direction (advancing direction) of the intermediate transfer belt (7) at each photosensitive drum (22).

Light irradiated from the neutralization light source (40) converts electrical potential on the surface of each photosensitive drum (22) to substantially zero. This makes it possible to charge the photosensitive drum (22) using the charging unit (24) in a stable manner.

The cleaning unit (25) that removes residual toner from the cylindrical surface of each photosensitive drum (22) is disposed directly below each neutralization light source (40). The cylindrical surface of the photosensitive drum (22) cleaned by the cleaning unit (25) is given a new charge by the charging unit (24) on a right side of the photosensitive drum (22), below the cleaning unit (25).

An electrostatic latent image is formed on the cylindrical surface of the photosensitive drum (22) charged by the charging unit (24) by laser light (L) that is controlled based on image data, from the laser radiating unit (6).

The developer unit (23) is disposed at a left side of the photosensitive drum (22). A toner of each color is supplied to the developer unit (23) to correspond to a toner of each color from each toner cartridge (27) disposed above the intermediate transfer belt (7). The developer unit (23) supplies toner to the electrostatic latent image formed on the photosensitive drum (22) to form the toner image on the photosensitive drum (22).

The neutralization light source (40) is disposed between the primary transfer position and the cleaning unit in the direction of rotation of the photosensitive drum (22).

The neutralization light source (40) is configured to irradiate light (a first neutralization light) in a region from a position opposing the primary transfer position in the photosensitive drum (22) which is the first image carrier that composes the image-forming unit (21) up to a position that opposes the cleaning unit (25), and to irradiate light (a second neutralization light) in a region from a position opposing the developer unit (23) corresponding to the photosensitive drum (22) which is a second image carrier that composes the image-forming unit (21) disposed adjacent to the above-mentioned image-forming unit (21) at a downstream side in the direction of rotation of the intermediate transfer belt (7) up to a position opposing the primary transfer position.

The neutralization light source (40) of the image-forming apparatus according to the present invention is composed of a substrates (41) and a plurality of red LEDs mounted on the substrates (41). Also, these red LEDs are composed to emit light by receiving electric power supplied via a power cable.

As shown in FIG. 3, neutralization light source (40) is installed above the cleaning unit (25) to be able to irradiate light (a first neutralization light) in a region between the primary transfer position of the photosensitive drum (22) and the cleaning unit (25). This enables the neutralization light source (40) to neutralize a residual electrical charge (neutralize after the image transfer) in that region after the toner image on the photosensitive drum (22) is transferred to the intermediate transfer belt (7).

This neutralization light source (40) is configured also to be able to irradiate light (a second neutralization light) on the photosensitive drum (22) of the image-forming unit (21) that is adjacent at the right side in the direction of rotation of the intermediate transfer belt (7) (a downstream side in the direction of rotation). The neutralization light source (40) irradiates light in the region where the toner image is formed on the photosensitive drum (22). This enables the neutralization light source (40) to uniformly neutralize electricity (neutralize before the image transfer) on the surface of the photosensitive drum (22) in the region where the toner image is formed.

Specifically, after the toner image is transferred to the intermediate transfer belt (7), the neutralization light source (40) simultaneously performs the first neutralization to neutralize residual electricity on the photosensitive drum (22) and the second neutralization to reduce the electrical potential over the entire cylindrical surface of the photosensitive drum (22) of the image-forming unit (21) that is adjacent in the rotation direction of the intermediate transfer belt (7) (downstream side). With this configuration, the image-forming apparatus (1) adequately neutralizes residual electricity on an image carrier without requiring a new discharge light source and without having to increase the transfer current setting. Therefore, this image-forming apparatus (1) accurately controls (suppresses) generation of transfer memory images, or exposure memory images.

In order for the charging unit (24) to provide a stable charging process, the first neutralization process reduces electrical potential on the cylindrical surface of each photosensitive drum (22) to substantially 0 by eliminating the potential the exists on each photosensitive drum (22). Because of this, a subsequent charge is made uniform.

The second neutralization process reduces electrical potential of non-image portions where no toner image exists on the photosensitive drum (22) after the developing process. This makes it possible to suppress the flow of transfer current into non-image portions. Furthermore, this also makes it possible to lower a transfer voltage setting at the primary transfer thereby reducing transfer memory.

Here, as shown in FIG. 3, the neutralization light source (40) is disposed so that a distance to a photosensitive drum (22) composing an image-forming unit (21) that includes the neutralization light source (40) is shorter than a distance to the photosensitive drum (22) that composes an adjacent image-forming unit (21).

More specifically, the neutralization light source (40) is disposed so that a light path length (a first light path length) of the light (the first neutralization light) irradiated onto a photosensitive drum (22) that composes an image-forming unit (21) that includes the neutralization light source (40) is shorter than a light path length (a second light path length) of the light (the second neutralization light) irradiated onto a photosensitive drum (22) that composes an adjacent image-forming unit (21).

Furthermore, in such a case, light (second neutralization light) irradiated onto the photosensitive drum (22) that composes the adjacent image-forming unit (21) is diffused thereby becoming a lower intensity than the light (first neutralization light) irradiated onto the photosensitive drum (22) that composes the image-forming unit (21) that includes the neutralization light source (40).

The furthest upstream image-forming unit (21) in the direction of rotation of the intermediate transfer belt (7) is not equipped with a neutralization light source (40) to irradiate the second neutralization light onto the photosensitive drum (22) that composes that image-forming unit (21). Specifically, a second neutralization light is not irradiated onto the photosensitive drum (22) that composes the image-forming unit (21) that is disposed at a furthest upstream side in the direction of rotation of the intermediate transfer belt (7).

The image-forming apparatus (1) of this embodiment of the present invention is configured to have a cleaning device (11) disposed at a furthermost upstream position in the rotation direction of the intermediate transfer belt (7). The cleaning device (11), which is a belt cleaning device, is disposed at an upstream side of the four image-forming units (21) in the rotation direction of the intermediate transfer belt (7), at an outside surface of the intermediate transfer belt (7).

This removes residual toner on the intermediate transfer belt (7). Therefore, the intermediate transfer belt (7) that opposes the furthest upstream image-forming unit (21) is cleaned by the cleaning device (11) so that it does not have residual toner.

For that reason, the primary transfer is highly efficient at the image-forming unit (21) of the most upstream position; the image-forming apparatus (1) of this embodiment of the present invention does not require a pre-transfer neutralization light source corresponding to this image-forming unit (21).

Preferred embodiments of the neutralization light source (40) of the image-forming apparatus according to the present invention will now be explained with reference to the drawings provided.

Figure 4:
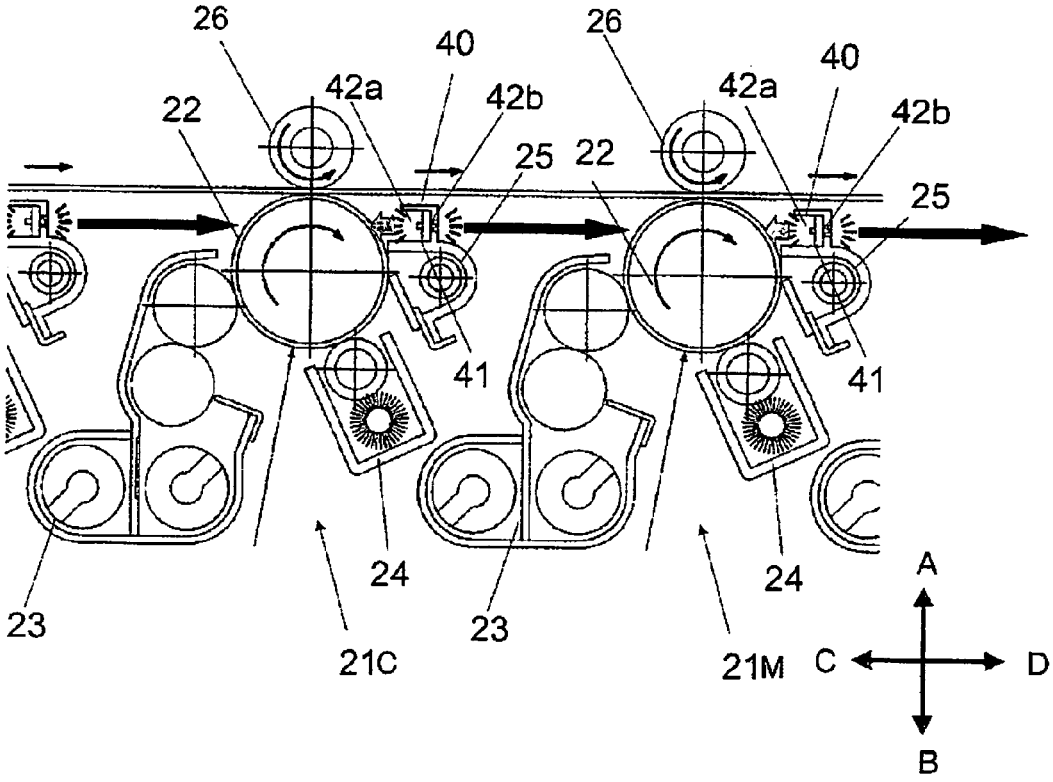
FIG. 4 is an expanded longitudinal sectional view of an embodiment of a neutralizing light source in the image-forming apparatus according to an embodiment of the present invention.

FIG. 4 is an expanded longitudinal sectional vie of an embodiment of a neutralization light source in the image-forming apparatus according to an embodiment of the present invention. Here, to facilitate explanations of the drawings, the arrows on the right side have the following meaning: A is upward; B is downward; C is the left side; and D is the right side.

The neutralization light source (40) of this embodiment is installed above the cleaning unit (25), and includes a substrate (41), and LED chips (42*a*, 42*b*) disposed on both surfaces of the substrate (41). The first LED (42*a*) is disposed on one surface of the substrate (41). The second LED (42*b*) is disposed on the other surface of the substrate (41).

The first LED chip (42*a*) is disposed so that light (first neutralization light) can be irradiated substantially parallel with the intermediate transfer belt (7), in a left direction which is a reverse direction of an advancing direction of the intermediate transfer belt (7). The first LED chip (42*a*) neutralizes residual electrical potential on the cylindrical surface of the photosensitive drum (22) after transfer to the intermediate transfer belt (7).

The second LED chip (42*b*) is disposed so that light (second neutralization light) can be irradiated substantially parallel with the intermediate transfer belt (7), in a right direction which is the same direction as the advancing direction of the intermediate transfer belt (7). The second LED chip (42*b*) lowers the overall electrical potential of the cylindrical surface of the photosensitive drum (22) of the adjacent image-forming unit (21). In such a case, the second LED chip (42*b*) is set to a low light intensity compared to the first LED chip (42*a*) to neutralize the entire cylindrical surface of the photosensitive drum (22).

Figure 5A:
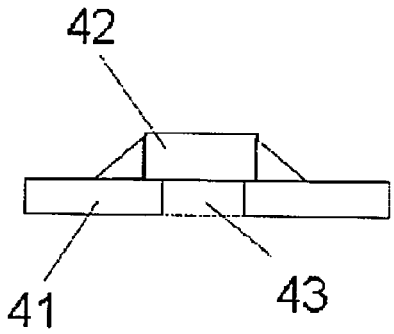
FIG. 5A is a schematic sectional view of a an embodiment equipped with an aperture for allowing light to pass through a substrate of a neutralization light source in the image-forming apparatus according to the present invention.
Figure 5B:
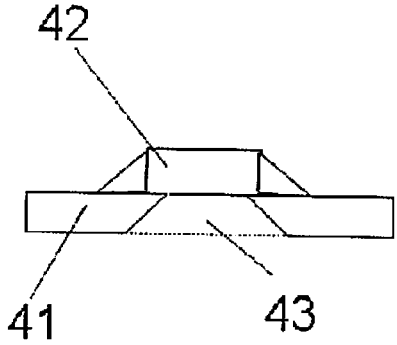
FIG. 5B is a schematic sectional view of another embodiment equipped with an aperture for allowing light to pass through a substrate of the neutralization light source in the image-forming apparatus according to the present invention.
Figure 6A:
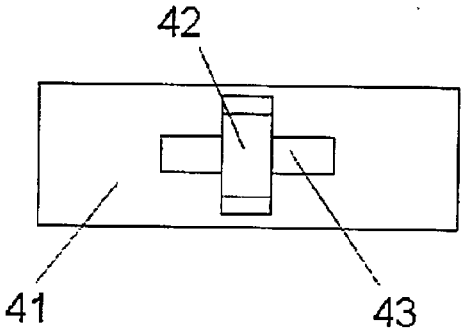
FIG. 6A is a plan view of an embodiment equipped with a long aperture extended in a lateral direction of the substrate in a neutralization light source in the image-forming apparatus according to the present invention.
Figure 6B:
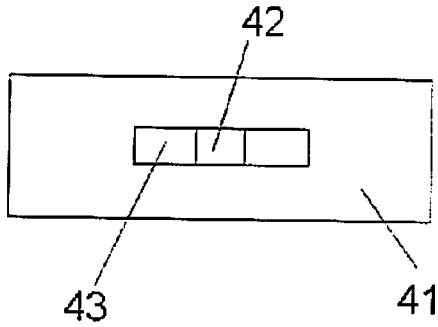
FIG. 6B is a rear view of an embodiment equipped with a long aperture extended in a lateral direction of a substrate in the neutralization light source in the image-forming apparatus according to the present invention.

FIG. 5A is a schematic sectional view of an embodiment equipped with an aperture that allows light to pass through a substrate of the neutralization light source in the image-forming apparatus according to the present invention. FIG. 5B is a schematic sectional view of another embodiment equipped with an aperture that allows light to pass through a substrate of a neutralization light source in the image-forming apparatus according to the present invention. FIG. 6A is a plan view of an embodiment equipped with a long aperture extended in a lateral direction of a substrate in the neutralization light source in the image-forming apparatus according to the present invention. FIG. 6B is a rear view of an embodiment equipped with a long aperture extended in a lateral direction of a substrate in the neutralization light source in the image-forming apparatus according to the present invention.

Here, to facilitate explanations of the drawings, a surface of the substrate equipped with the LED chips (42) shown in FIGS. 5A and 5B is a front surface (a surface of one direction), and the surface of the substrate unequipped with the LED chips is the rear surface (a surface of another direction); left and right directions shown in FIGS. 6A and 6B are lateral directions, and up and down directions are longitudinal directions.

As shown in FIGS. 3, 5A and 5B, in the neutralization light sources (40) of this embodiment installed above cleaning units (25), the substrate (41), and an LED chip (42), which is a light source, is disposed on a front surface (a surface of one side) of the substrate (41).

Also, an aperture (43) that is a penetrating aperture is formed where the LED chip (42) is installed on the substrate (41). The neutralization light source (40) is configured so that a portion of the light irradiated from the LED chip (42) is transmitted through the aperture (43) and guided to a rear surface side of the substrate (41).

Here, as shown in FIG. 5B, for the shape of the aperture (43) of the substrate (41), it is acceptable for the aperture portion at a rear surface side of the substrate (41) to be larger than the aperture portion at a front surface side so that LED chip (42) light is diffused. With this configuration, light of the LED chip (42) that passes through the aperture (43) is diffused toward the rear surface side of the substrate (41).

The aperture (43) is positioned on the substrate (41) of the neutralization light source (40) where the LED chip (42) is disposed, it is preferred that the shape of the aperture (43) is configured to be lateral, as shown in FIGS. 6A and 6B. With this configuration, the light of the LED chip (42) is guided to the rear surface direction (side) of the substrate (41) and a wide range in the axis direction of the photosensitive drum (22).

In such a case, the LED chip (42) is disposed in a longitudinal direction (up and down directions) with regard to the substrate (41); the aperture (43) is formed to be a long shape in the lateral direction. With this configuration, light from the LED chip (42) is diffused in a axis direction, which is the rear surface direction of the substrate (41). Said another way, that light is diffused in a axis direction of the photosensitive drum (22) of an adjacent image-forming unit (21) in the direction of rotation of the intermediate transfer belt (7). Therefore, this configuration makes it possible to prevent non-uniform light intensity in the axis (shaft) direction of the photosensitive drum (22), and to lower the electrical potential of the entire cylindrical surface of the photosensitive drum (22) uniformly.

The neutralization light source (40) of another embodiment is installed above the cleaning unit (25), and includes the LED chip (42), which is the light source, and a light-transmissive substrate (41).

The LED chip (42) is disposed at a front surface side (surface side of one direction) of the light-transmissive substrate (41). The light-transmissive substrate (41) is configured to allow a portion of the light irradiated from the LED chip (42) to be transmitted to a rear surface side of the substrate (41).

The neutralization light source (40) diffuses light irradiated from the LED chip (42) in the rear surface direction of the substrate (41), and uniformly lowers the electrical potential of the entire surface of the photosensitive drum (22) of an adjacent image-forming unit (21) in the direction of rotation of the intermediate transfer belt (7).

As a material for the light-transmissive substrate, it is preferable to use a substrate made of glass, phenolic paper or epoxy resin.

Figure 7:
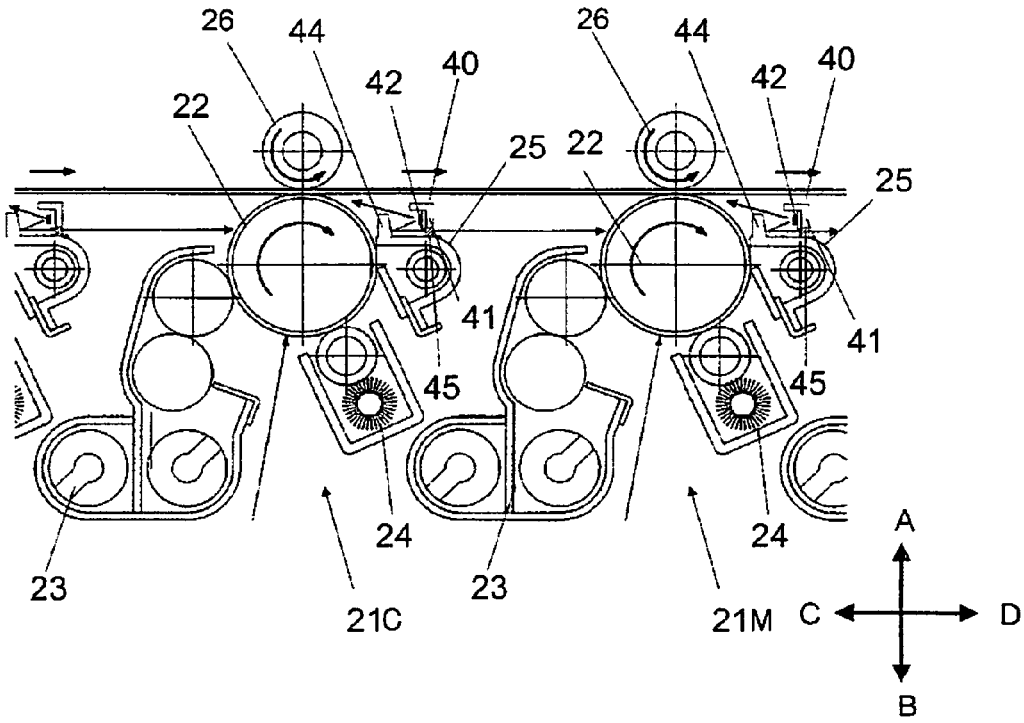
FIG. 7 is an expanded longitudinal sectional view of an embodiment of a neutralization light source equipped with a light reflecting member in the image-forming apparatus according to the present invention.

FIG. 7 is an expanded longitudinal sectional view of an embodiment of a neutralization light source equipped with a light reflecting member in the image-forming apparatus according to the present invention. Here, to facilitate explanations of the drawings, the arrows on the right side have the following meaning: A is upward; B is downward; C is the left side; and D is the right side. Furthermore, arrows that use the neutralization light source (40) as a starting point, indicate the direction of the movement of light (or the light path).

The neutralization light source (40) of this embodiment is installed above the cleaning unit (25), as shown in FIG. 7, and includes the LED chip (42), which is a light source, the substrate (41), and a light-reflecting member (44). In this embodiment, a light-transmissive slit (45) is formed in the substrate (41). The light-reflecting member (44) reflects a portion of the light irradiated from the LED chip (42) onto the photosensitive drum (22) that composes the adjacent image-forming unit (21).

The light-reflecting member (44) of the neutralization light source (40) is disposed opposite to the LED chip (42). The neutralization light source (40) is configured so that a portion of the light irradiated from the LED chip (42) reaches near the nipping position formed between the intermediate transfer belt (7) and the photosensitive drum (22) in the photosensitive drum (22), and another portion is irradiated onto the light-reflecting member (44).

The light-reflecting member (44) is disposed to reflect irradiated light toward the light-transmissive slit (45). Also, the light-transmissive slit (45) is configured to allow light to pass therethrough; it guides irradiated light toward the rear surface side (the other surface side) of the substrate (41).

Light that reaches the rear surface side of the substrate (41) is irradiated onto the photosensitive drum (22) of the adjacent image-forming unit (21) at a downstream side in the direction of rotation of the intermediate transfer belt (7). The neutralization light source (40) is configured to neutralize (the second neutralization, the neutralization before image transfer) the cylindrical surface of the photosensitive drum (22) before transferring the toner image, after the toner image has been formed.

Here, the conditions (setup angle, reflectance ratio, curvature of the reflective surface, size, and other factors) related to the light-reflecting member easily can be changed by adjusting each one.

With the aforementioned embodiments, it is possible adequately to neutralize residual electricity on an image carrier without requiring a new discharge light source and without having to increase the transfer current setting. Therefore, the present invention accurately suppresses generation of transfer memory images and exposure memory images. Furthermore, it is not necessary to dispose a plurality of neutralization light sources, so costs are held down. Furthermore, there is no need to increase transfer currents, so power is conserved.

The neutralization light source of the image-forming apparatus according to the present invention can be utilized in a variety of systems including copy machines, printers, facsimile machines or MFP (Multifunction Peripheral).

What is claimed is:

1. An image-forming apparatus comprising: a circulating transfer belt that rotates in a predetermined direction;

a plurality of image-forming units disposed at predetermined distances in a direction of transfer belt rotation, each including an image carrier disposed opposite to a primary transfer position at an outer surface side of the transfer belt, configured to rotate around a rotating axis;

a charging unit for uniformly charging the image carrier;

an exposure unit that forms an electrostatic latent image on the image carrier;

a developer unit that uses toner to form a toner image by developing the electrostatic latent image formed by the exposure unit;

a neutralization light source that neutralizes an electric charge on the image carrier by radiating light onto the image carrier; and a cleaning unit that cleans away residual toner on the image carrier;

wherein in at least one image-forming unit of the plurality of image-forming units, the neutralization light source comprises:

a substrate; and a first neutralization light and a second neutralization light, the neutralization light source being attached to the substrate and irradiating the first neutralization light on one side of the substrate and the second neutralization light on the other side of the substrate, the neutralization light source is disposed between a primary transfer position and the cleaning unit, in a direction of rotation of a first image carrier that composes the one image-forming unit;

irradiates the first neutralization light from a position opposing the primary transfer position on the first image carrier up to a position opposing the cleaning unit; and irradiates the second neutralization light from a position opposing the developer unit for a second image carrier that composes another image-forming unit disposed adjacent to the one image-forming unit at a downstream side in the direction of transfer belt rotation, up to a position opposite the primary transfer position.

2. The image-forming apparatus according to claim 1, wherein the neutralizing light source is disposed so that a light path length of the first neutralization light is shorter than a light path length of the second neutralization light.

3. The image-forming apparatus according to claim 1, wherein the second neutralization light has a lower intensity than the first neutralization light.

4. The image-forming apparatus according to claim 1, wherein the neutralization light source is equipped with:

a first LED which is disposed on one surface of the substrate emitting the first neutralization light; and a second LED which is disposed on the other surface of the substrate emitting the second neutralization light.

5. The image-forming apparatus according to claim 4, wherein the second LED is set to a lower light intensity compared to the first LED.

6. The image-forming apparatus according to claim 1, wherein the neutralization light source is equipped with:

a light source unit; and a light-reflective member for reflecting a portion of light irradiated from the light source unit to the second image carrier.

7. The image-forming apparatus according to claim 1 further comprising a cleaning device disposed opposite an upstream side of the plurality of image-forming units in the rotation direction of the intermediate transfer belt, at an outside surface of the intermediate transfer belt, for removing residual toner on the transfer belt; and a second neutralization light is not irradiated onto an image carrier that composes an image-forming unit disposed at a furthest upstream side in the direction of rotation of the intermediate transfer belt of the plurality of image-forming units.

8. An image-forming apparatus comprising: a circulating transfer belt that rotates in a predetermined direction;

a plurality of image-forming units disposed at predetermined distances in a direction of transfer belt rotation, each including an image carrier disposed opposite to a primary transfer position at an outer surface side of the transfer belt, configured to rotate around a rotating axis;

a charging unit for uniformly charging the image carrier;

an exposure unit that forms an electrostatic latent image on the image carrier;

a developer unit that uses toner to form a toner image by developing the electrostatic latent image formed by the exposure unit;

a neutralization light source that neutralizes an electric charge on the image carrier by radiating light onto the image carrier; and a cleaning unit that cleans away residual toner on the image carrier;

wherein in at least one image-forming unit of the plurality of image-forming units, the neutralization light source is disposed between a primary transfer position and the cleaning unit, in a direction of rotation of a first image carrier that composes the one image-forming unit;

irradiates a first neutralization light from a position opposing the primary transfer position on the first image carrier up to a position opposing the cleaning unit; and irradiates a second neutralization light from a position opposing the developer unit for a second image carrier that composes another image-forming unit disposed adjacent to the one image-forming unit at a downstream side in the direction of transfer belt rotation, up to a position opposite the primary transfer position, wherein the neutralization light source is equipped with:

a substrate;

a light source unit disposed on one surface of the substrate; and an aperture formed in the substrate to allow a portion of light irradiated from the light source unit to pass from the one surface to the other surface of the substrate.

9. The image-forming apparatus according to claim 8, wherein an opening portion of the other surface of the substrate is formed to be larger than an opening at the one surface of the substrate.

10. The image-forming apparatus according to claim 8, wherein the aperture is formed to extend along a rotating axis direction in the second image carrier.

11. An image-forming apparatus comprising: a circulating transfer belt that rotates in a predetermined direction;

a plurality of image-forming units disposed at predetermined distances in a direction of transfer belt rotation, each including an image carrier disposed opposite to a primary transfer position at an outer surface side of the transfer belt, configured to rotate around a rotating axis;

a charging unit for uniformly charging the image carrier;

an exposure unit that forms an electrostatic latent image on the image carrier;

a developer unit that uses toner to form a toner image by developing the electrostatic latent image formed by the exposure unit;

a neutralization light source that neutralizes an electric charge on the image carrier by radiating light onto the image carrier; and a cleaning unit that cleans away residual toner on the image carrier;

wherein in at least one image-forming unit of the plurality of image-forming units, the neutralization light source is disposed between a primary transfer position and the cleaning unit, in a direction of rotation of a first image carrier that composes the one image-forming unit;

irradiates a first neutralization light from a position opposing the primary transfer position on the first image carrier up to a position opposing the cleaning unit; and irradiates a second neutralization light from a position opposing the developer unit for a second image carrier that composes another image-forming unit disposed adjacent to the one image-forming unit at a downstream side in the direction of transfer belt rotation, up to a position opposite the primary transfer position, wherein the neutralization light source is equipped with:

a light source unit; and a light-transmissive substrate, on one surface of which the light source unit is positioned, allowing a portion of light irradiated from the light source unit to pass from the one surface to the other surface.

* * * * *